US005169152A

United States Patent [19]

Marquardt

[11] Patent Number: 5,169,152

[45] Date of Patent: Dec. 8, 1992

[54] GOLF CLUB GRIP

[76] Inventor: Mark R. Marquardt, 925 Monticello Dr., Naperville, Ill. 60540

[21] Appl. No.: 799,194

[22] Filed: Nov. 27, 1991

[51] Int. Cl.[5] ..... A63B 69/36; A63B 53/14

[52] U.S. Cl. ..... 273/187.5; 273/81.4; 273/77 R

[58] Field of Search ..... 273/81.4, 81, 165, 163, 273/77 B, 183 D, 186 A, 186 C, 186 D, 194 R, 81 D, 81 B, 166, 81.2, 81.3

[56] References Cited

U.S. PATENT DOCUMENTS

| | | | |
|---|---|---|---|
| 2,865,635 | 12/1958 | Jessen | 273/163 R X |
| 3,072,955 | 1/1963 | Mitchell | 273/81 R |
| 3,880,443 | 4/1975 | Tobin | 273/165 X |
| 4,361,326 | 11/1982 | Kokes | 273/165 X |

FOREIGN PATENT DOCUMENTS

| | | | |
|---|---|---|---|
| 2124089 | 2/1984 | United Kingdom | 273/81.4 |

*Primary Examiner*—George J. Marlo

*Attorney, Agent, or Firm*—Hill, Van Santen, Steadman & Simpson

[57] ABSTRACT

There is disclosed herein an enlarged and elongated hand grip for use with a golf club. The grip includes an elongated tubular body portion which is elliptically shaped. The body portion includes a flat in the front surface for use in grasping and aligning the club. The body also includes a lower end which includes a flat front portion and an arcuate back portion. This lower end shape is constructed to adapt to the shape of the lower hand so as to permit grasping and control of movement of the grip and club. A plurality of transverse alignment markings are provided on the flat for assisting the user in reproducible finger and hand positioning. Moreover, an alignment marker is provided adjacent the club head end of the grip which is to be generally aligned with the club shaft and head and for assisting the user in alignment of a putt.

7 Claims, 1 Drawing Sheet

GOLF CLUB GRIP

BACKGROUND OF THE INVENTION

This invention relates to golf clubs and, more particularly, to an improved grip system for golf clubs known as "putters".

In the game of golf an object is to hit or drive the ball from a distant position to a green in which there is a hole. Once on the green, the object is to putt the golf ball into the hole. Putters have gone through a number of design evolutions and it is not unusual that a player will find that a particular golf club "putter" of a particular design is desired by that player.

A number of patents have been located dealing with improvements in golf clubs and putters in particular. Those patents include U.S. Pat. Nos. 1,506,523; 4,067,573; 4,082,286; 4,162,074; 4,077,633; 4,215,860; 4,272,077; 4,795,158 and UK Patent Application 2,124,089A. These patents disclose many features which have been deemed to be useful.

At the present time elongated putters are believed to be preferable and are approximately chest high, and the user putts in a standing rather than stooped position. From the standing position a pendulum-like swing is imparted to the golf club for striking and guiding the ball. Putters of this type normally include a club head, a round shaft, and a grip that is cross-sectionally similar to the body of the club shaft. The grip may be a wrapping or a separate member. In this position the hands of the user grasp the grip and the user's arms are generally aligned with the club.

The use of enlarged grips with golf clubs are known and intended to provide the user with a better grasp of the club. However, the use of enlarged grips, particularly with elongated putters, has not been adopted.

It is an object of this invention to provide an improved enlarged grip for use with an elongated putter so as to improve the accuracy of putting.

These and other objects of this invention will become apparent from the following description, drawings and appended claims.

SUMMARY OF THE INVENTION

There is provided by this invention an improved and enlarged grip for use with elongated putters which is believed to improve the accuracy of putting.

The grip is mounted on the golf club shaft in the gripping area at the end of the club opposite the club head. The grip includes an enlarged and tubular body having a pair of ends with one end being closer to the club head than the other end. The grip has a generally elliptically shaped cross-section so as to permit easy grasping by a human hand. In addition, the grip includes in its surface an elongated flat or grooved area which is generally aligned with the shaft and is on the club head side of the shaft. The groove can also be ruled so as to enhance alignment. In other words, the groove is positioned toward the front of the shaft. The grip also includes a unique bottom surface which is flat on the club head side of the shaft but is arcuate or curved from the shaft to the backside. Moreover, the grip includes an alignment line, which is aligned with the shaft and club head to assist in aligning a shot.

The shape of the grip permits a user to grasp the same so that the top hand can surround the grip with the finger ends resting on the flat for purposes such as location, alignment, etc. The lower hand is positioned transversely to the shaft and is arranged such that the shaft fits between the fingers of the lower hand, usually the index finger and the third finger. The other three fingers of the hand then conform to the arcuate shape. In other words, the lower hand "holds" the grip from the bottom. This permits the club to be swung in a pendulum-like manner whereby the upper hand defines the pivot point and the lower hand provides the force for striking the ball. This arrangement is believed to be more useful than the prior art and has been successfully employed.

DESCRIPTION OF THE PREFERRED EMBODIMENT

Figure 1:
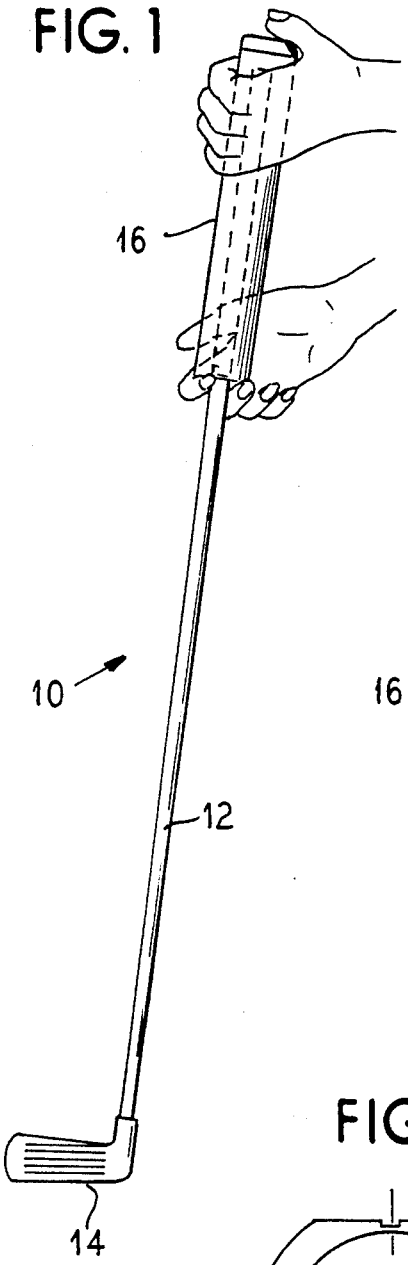
FIG. 1 is a side view of a club with the enlarged grip of this invention.

Referring now to FIG. 1, there is shown a golf club 10 generally which includes a shaft 12, head 14 and a grip 16. As seen in the drawing, the grip 16 is substantially larger in cross-section than the shaft 12.

The grip 16 is fitted to the shaft by an internal bore and secured thereby.

Figure 2:
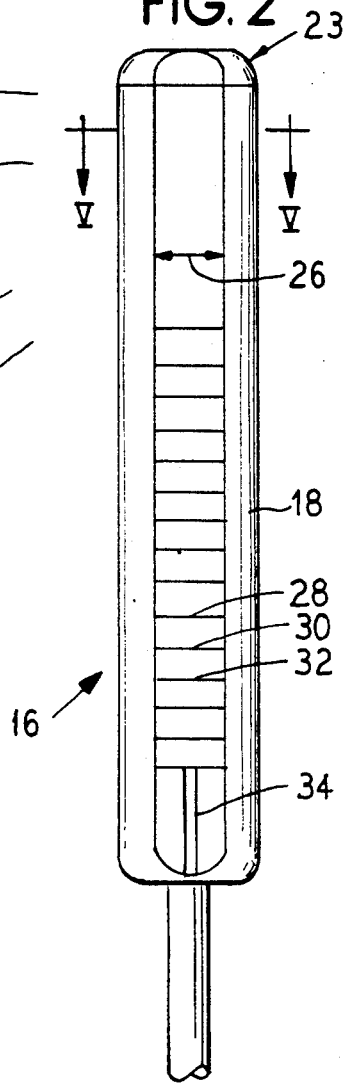
FIG. 2 is a front view of the grip showing the finger engaging flat.
Figure 3:
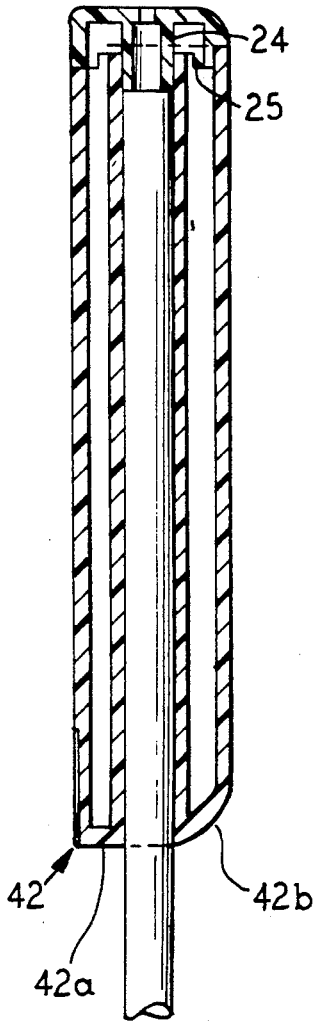
FIG. 3 is a side view of the enlarged grip showing the bottom surface and its accurate position.
Figure 4:
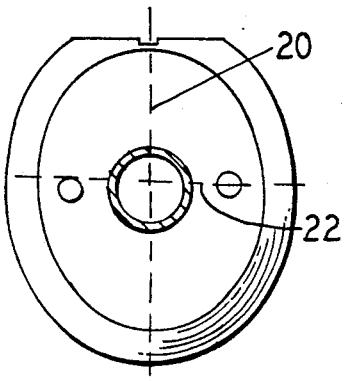
FIG. 4 is an end view of the grip.

Referring to FIG. 2, the grip 16 has an elongated body portion 18 which is approximately 9-$\frac{3}{4}$" long and has an elliptical cross-section in which the major axis 20 is approximately 2-$\frac{1}{4}$" long and a minor axis 22 is about 1-$\frac{3}{4}$".

In addition, the grip includes an end plug or thumb rest 23 which is designed to fit at the top end of the grip. It has a plug-like projection 24 that fits within the grip and shaft and an annular collar 25 for holding the plug in the grip.

A significant feature of the grip is that in the front is an elongated flat 26 which extends longitudinally along the front surface of the grip for approximately the entire length of the grip. The flat is approximately $\frac{7}{8}$ of an inch across, is provided for grasping by the fingers, the rotary positioning of the club, and assisting in grasping of the grip.

The grip is also ruled with a series of spaced transverse lines such as 28, 30 and 32. These lines cooperate with the grip and shaft to permit the user to consistently reposition his hand and fingers on the grip for more consistent putting. Furthermore, the grip has a longitudinal alignment marker 34 at the lower end of the front of the grip which is aligned with the shaft and head and cooperates in alignment for the user.

Figure 5:
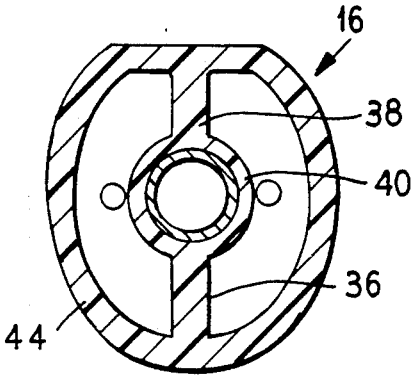
FIG. 5 is a sectional view taken along line V—V of FIG. 3 showing a cross-section of the grip.

Referring now to FIG. 5, the grip 16 is shown in section and includes a pair of internal webs 36 and 38 and an internal bore in the form of a tube 40 for engaging the golf club shaft. The cap plug 24 fits within the internal bore 40 or a bore in the golf club shaft 12.

The lower end 42 of the grip includes a front **42*a* and a back 42*b* portion. The front portion 42*a* extends from the front of the grip to the shaft 12, is substantially flat and is transverse to the shaft. However, the back portion 42*b*** of the grip is arcuate and generally curves from the shaft to the back of the grip. The curvature is important so that the rear fingers of the user such as the small, the fourth, and third fingers of the hand can grasp the grip.

The enlarged grip is made as light as possible for use. In order to do so, it is a hollow member, but which includes an external sleeve-like member 44 for grasping by the hand and the internal tubular member 40 for grasping the club. The external member 44 and internal member 40 are interconnected by the webs 36 and 38, which can be viewed as in effect suspending the internal member inside the external member. The lower portion of the grip is molded closed and the upper portion is open, but closable with the plug 23. In this embodiment the grip is an injection molded member. The grip can also be a foamed rubber member rather than an injection molded member described hereinbefore.

Although the invention has been described with respect to preferred embodiment, it is not to be so limited as changes and modifications can be made which are within the full intended scope of the invention as defined by the appended claims.

I claim:

1. An enlarged hand grip for use with a golf club which includes a club head and a shaft, the grip constructed to be mounted to a golf club shaft, said grip comprises:

an elongated and tubular body portion and a pair of ends, one end being a club head end and the other end being a user end;

said tubular body having a cross-section which is generally elliptically shaped, having a wide side and a narrow side, and a periphery about which a human hand can fit;

said tubular body defining an elongated central tubular opening for receiving and grasping a club shaft;

said tubular body having an elongated finger-receiving flat along a narrow side thereof and constructed to be aligned with the plane of a club head and a shaft; and said club head end being generally transverse to the central tubular opening and having a generally flat surface transverse to the body between the finger-receiving flat and the central opening and having a generally arcuate finger-receiving surface extending from the central opening to the side of the grip opposite the flat and joining the opposite side of the grip;

so that said club head end of the grip can rest in a user's hand with a finger on the flat and other remaining fingers on the arcuate surface and said grip adapted to be grasped by a second hand of a user so as to engage said grip periphery and contact the finger-receiving flat.

2. A grip as in claim 1, wherein said body is an injection molded member having an external hand grasping sleeve, an internal shaft grasping sleeve, and a plurality of web-like connecting members joining said internal and external sleeves.

3. A grip as in claim 2, wherein the user end is formed by a removable cap having an internal plug member adapted to engage the internal sleeve and a collar-like member adapted to engage the inside surface of the external sleeve.

4. A grip as in claim 2, wherein the grip is formed of a molded elastomeric material.

5. A grip as in claim 1, wherein there is provided a plurality of transverse rule-like markings on the finger-receiving flat for use in permitting reproducible positioning of a finger.

6. A grip as in claim 5, wherein there is further provided an elongated longitudinal alignment marker associated with the finger receiving flat adjacent the club head end for alignment with the longitudinal axis of the flat and with a club shaft and a club head for use by a user in aligning a user's stroke.

7. An enlarged hand grip for use with a golf club which includes a club head and a shaft, the grip constructed to be mounted to a golf club shaft, said grip comprises:

an elongated and tubular body portion and a pair of ends, one end being a club head end and the other end being a user end;

said tubular body having a cross-section which is generally elliptically shaped, having a wide side and a narrow side, and a periphery about which a human hand can fit;

said tubular body defining an elongated central tubular opening for receiving and grasping a club shaft;

said tubular body having an elongated finger-receiving flat along a narrow side thereof and constructed to be aligned with the plane of a club head and a shaft; and said club head end being generally transverse to the central tubular opening having a generally flat surface transverse to the body between the finger-receiving flat and the central opening and having a generally arcuate finger-receiving surface extending from the central opening to the side of the grip opposite the flat and joining the opposite side of the grip;

so that said club head end of the grip can rest in a user's hand with a finger on the flat and other fingers on the arcuate surface and said grip adapted to be grasped by a second hand of a user so as to engage said grip periphery and contact the finger receiving flat and wherein:

said body is an injection molded member of an elastomeric material having an external hand grasping sleeve, an internal shaft grasping sleeve spaced inward from said external sleeve, and a plurality of web-like connecting members joining said internal and external sleeves;

the user end is formed by a removable cap having an internal plug member adapted to engage the internal sleeve and a collar-like member adapted to engage the inside surface of the external sleeve;

there is provided a plurality of transverse rule-like markings on the finger-receiving flat for use in permitting reproducible positioning of a finger; and there is further provided an elongated and longitudinal alignment marker associated with the finger-receiving flat adjacent the club head end for alignment with a club shaft and a club head and for use by a user in aligning a user's stroke.

* * * * *